US012108857B1

(12) United States Patent
Ma

(10) Patent No.: US 12,108,857 B1
(45) Date of Patent: Oct. 8, 2024

(54) POWER CORD STORAGE STRUCTURE OF A HAIR DRYER

(71) Applicant: Wenjuan Ma, Dengzhou Henan (CN)

(72) Inventor: Wenjuan Ma, Dengzhou Henan (CN)

( * ) Notice: Subject to any disclaimer, the term of this patent is extended or adjusted under 35 U.S.C. 154(b) by 0 days.

(21) Appl. No.: 18/649,347

(22) Filed: Apr. 29, 2024

(51) Int. Cl.
*A45D 20/12* (2006.01)

(52) U.S. Cl.
CPC ..... *A45D 20/12* (2013.01)

(58) Field of Classification Search
CPC ..... A45D 20/12
USPC ..... 34/95–100
See application file for complete search history.

(56) References Cited

U.S. PATENT DOCUMENTS

| | | | | | |
|---|---|---|---|---|---|
| 2,745,192 | A * | 5/1956 | Crise | A45D 20/20 | 219/532 |
| 3,267,587 | A * | 8/1966 | Niemiec | A45D 20/22 | D28/17 |
| 4,528,440 | A * | 7/1985 | Ishihara | A45D 20/12 | 392/385 |
| 5,857,263 | A * | 1/1999 | Chan | A45D 20/12 | 34/97 |
| 5,884,008 | A * | 3/1999 | Goldberg | A45D 20/12 | 219/202 |
| 6,199,295 | B1 * | 3/2001 | Smal | A45D 20/122 | 34/98 |
| 6,393,718 | B1 * | 5/2002 | Harris | A45D 20/12 | 34/96 |
| 7,062,870 | B1 * | 6/2006 | You | D06F 75/34 | 38/88 |
| 9,414,662 | B2 * | 8/2016 | Moloney | A45D 20/00 | |
| 9,498,039 | B2 * | 11/2016 | Matsui | A45D 20/12 | |
| 11,388,972 | B2 * | 7/2022 | Lei | H02J 7/0045 | |
| 11,457,713 | B2 * | 10/2022 | Conrad | A45D 20/10 | |
| 11,602,208 | B2 * | 3/2023 | Lo | A45D 20/12 | |

FOREIGN PATENT DOCUMENTS

| | | | | |
|---|---|---|---|---|
| CN | 113811223 A * | 12/2021 | A45D 20/00 | |
| EP | 3721748 A2 * | 10/2020 | A45D 20/10 | |
| GB | 2610361 A * | 3/2023 | A45D 20/00 | |
| JP | 2022076988 A * | 5/2022 | A45D 20/12 | |
| WO | WO-2022100038 A1 * | 5/2022 | A45D 20/12 | |

* cited by examiner

*Primary Examiner* — Stephen M Gravini

(57) ABSTRACT

The present utility model discloses a power cord storage structure of a hair dryer, and belongs to the technical field of hair dryers. The power cord storage structure of the hair dryer includes a winding part for winding the power cord of the hair dryer, which can be installed on the hair dryer. A retaining member is fixedly provided on the winding part to maintain the initial winding state of the power cord. By setting the winding part on the hair dryer, the power cord storage structure can quickly and effectively store the power cord by winding it around the winding part and has the advantages of tidiness, neatness, space saving, etc. Additionally, a baffle is fixedly provided on the winding part to prevent the power cord from slipping off the winding part, thereby improving the storage effect.

6 Claims, 6 Drawing Sheets

POWER CORD STORAGE STRUCTURE OF A HAIR DRYER

TECHNICAL FIELD

The utility model relates to the technical field of hair dryers, in particular to a power cord storage structure of a hair dryer.

BACKGROUND ART

As an effective tool for drying wet hair and styling, hair dryers are widely used and have a high frequency of use. They are almost essential in every household and are used by everyone.

Generally, hair dryers are equipped with fixed power cords. However, a common problem arises when it is necessary to place the hair dryer after use: it is difficult to quickly and effectively store the power cord of the hair dryer, making it neat, tidy, and space-saving.

BRIEF SUMMARY OF THE INVENTION

The purpose of the utility model is to solve the inconvenience of storing the power cord of a hair dryer in the existing technology, which affects aesthetics and takes up space. Therefore, the utility model provides a power cord storage structure of the hair dryer.

To achieve the above purpose, the utility model adopts the following technical solution:

The power cord storage structure of the hair dryer comprises a winding part for winding the power cord, which can be installed on the hair dryer. A retaining member is fixedly provided on the winding part to maintain the initial winding state of the power cord.

To facilitate the winding of the power cord, preferably, the winding part comprises a winding board, which is plate-shaped or columnar.

To facilitate the connection between the winding board and the hair dryer housing, preferably, the winding board is integrally formed with the hair dryer housing.

For the convenience of installing and removing the winding board, the power cord storage structure of the hair dryer further includes fixedly setting the first fixing strap and the second fixing strap on the winding part. One end of the first fixing strap and the second fixing strap are both fixedly connected to the winding board, while the free ends of the first fixing strap and the second fixing strap are bundled on the hair dryer housing through connecting components.

Furthermore, the connecting components comprise a first limiting column, fixedly set on the free end of the first fixing strap. Multiple sets of first connecting grooves are equidistantly arranged on the second fixing strap, and the first limiting column is engaged with the first connecting groove.

Further, the retaining member includes a baffle 101 fixedly provided on the winding board 1, forming a winding area between the baffle 101 and the hair dryer housing.

Further, the power cord storage structure also comprises a third fixing strap equidistantly provided with multiple sets of second connecting grooves. One end of the third fixing strap is fixedly connected to the baffle, and the other end is a free end. When the free end is restricted, the third fixing strap 3 closes the winding area.

Further, a second limiting column is fixedly provided on the first fixing strap and is engaged with the second connecting groove.

Even further, a second limiting column is fixedly provided on the hair dryer housing, engaging with the second connecting groove.

Compared to the prior art, the utility model provides the power cord storage structure of the hair dryer with the following advantages:

1. According to the power cord storage structure of the hair dryer, by setting up a winding part on the hair dryer, the power cord can be wound around the winding part, achieving quick and effective storage. The power cord storage structure also possesses the effects of neatness, aesthetic appeal, and space saving. Additionally, the baffle fixedly set on the winding part prevents the power cord from slipping off, enhancing the storage effectiveness.
2. By fixing a third fixing strap on the baffle, the power cord can be wound around the winding part to prevent it from loosening or falling off, thus maintaining the storage effectiveness.

The parts not mentioned in this device are either similar to existing technology or can be implemented using existing technology. By setting up the winding part on the hair dryer, the utility model achieves quick and effective storage of the power cord, while also providing neatness, aesthetic appeal, and space-saving features. Furthermore, the fixed baffle on the winding part prevents the power cord from slipping off, thereby improving the storage effectiveness.

DESCRIPTIONS OF THE FIGURES

DETAILED DESCRIPTION OF THE INVENTION

Figure 1:
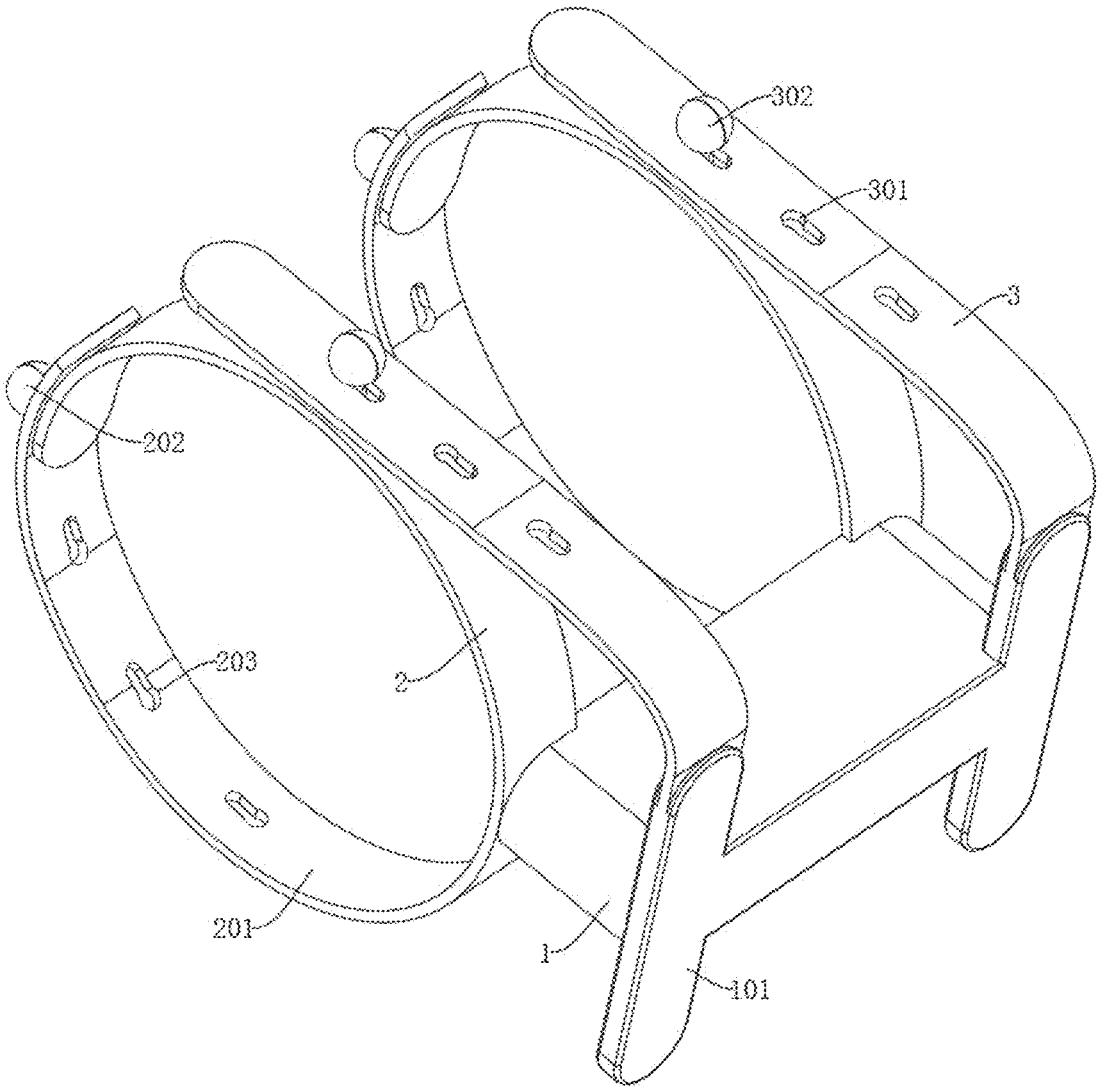
FIG. 1 is a schematic diagram of the power cord storage structure for the hair dryer provided in the utility model.
Figure 2:
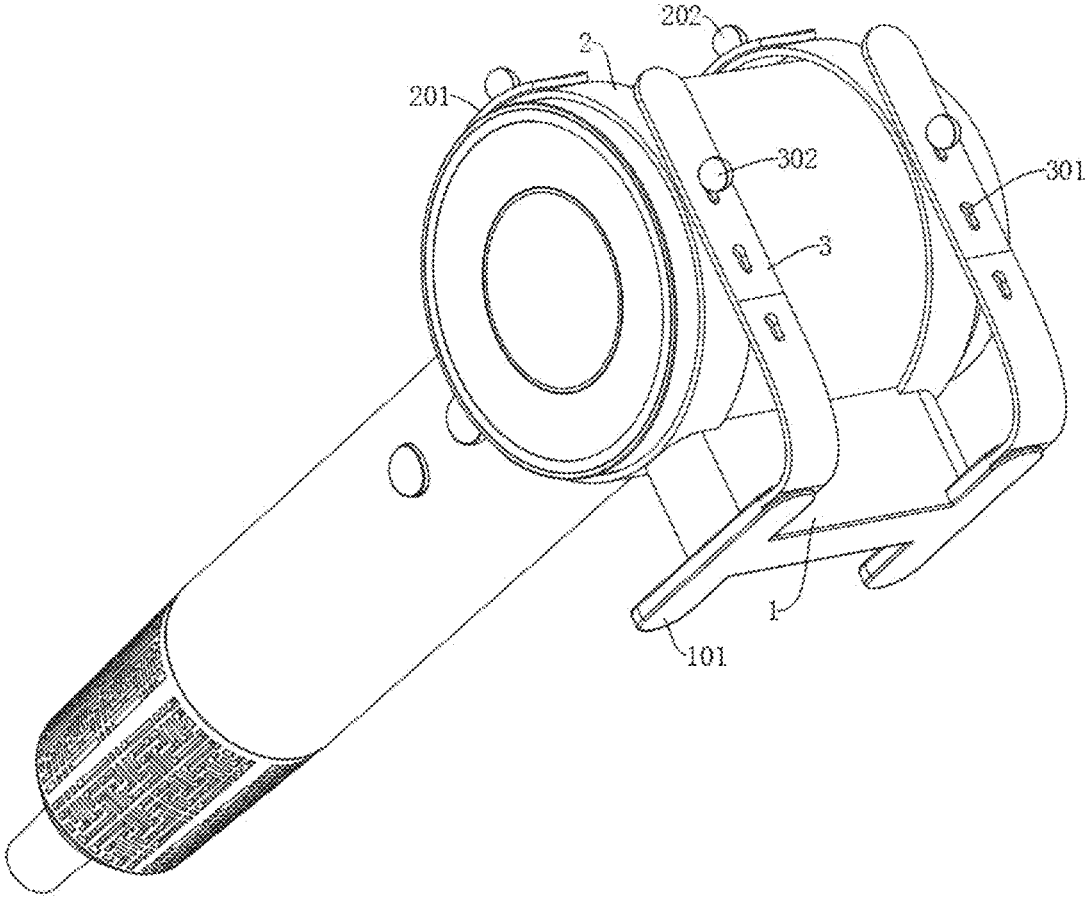
FIG. 2 is a schematic diagram of the power cord storage structure for the hair dryer provided in the utility model.
Figure 3:
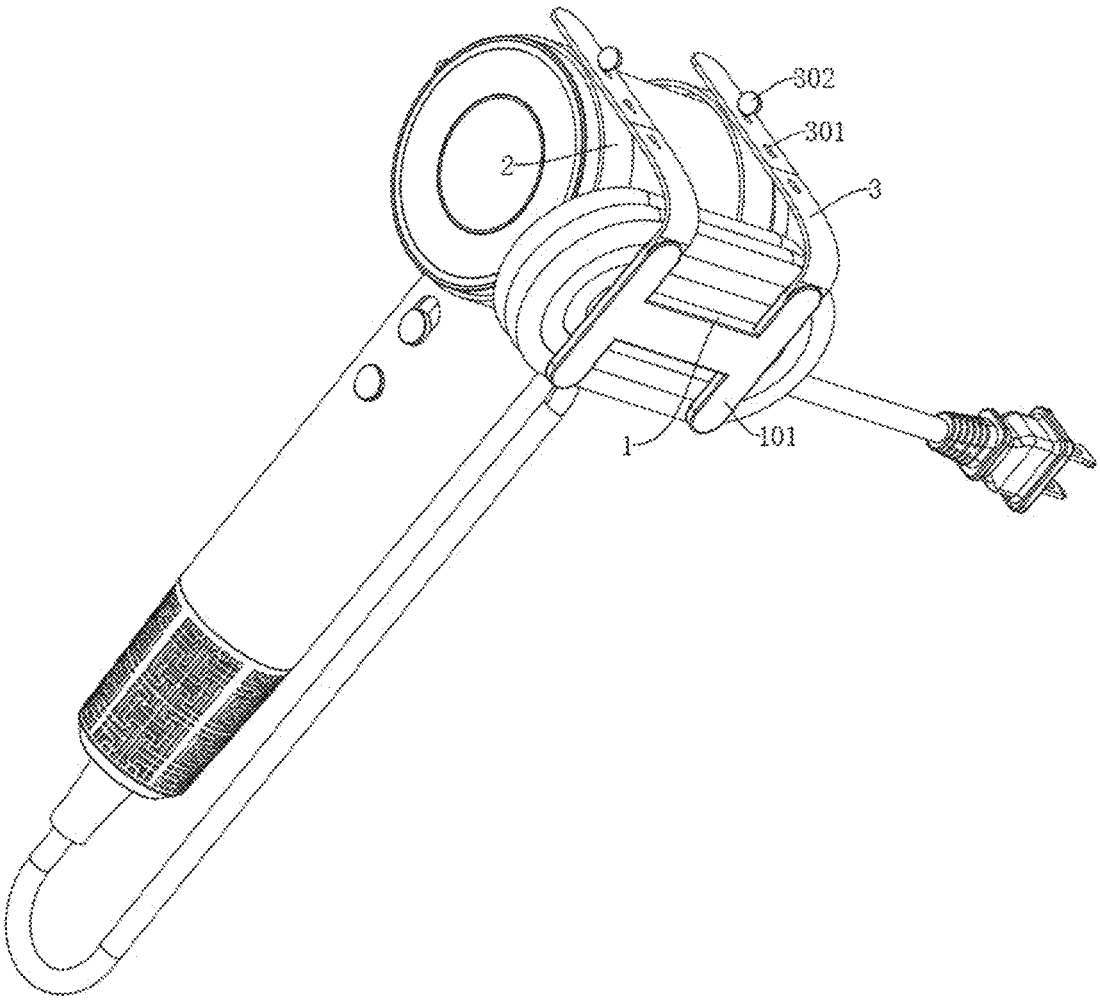
FIG. 3 is a schematic diagram of the power cord storage structure for the hair dryer provided in the utility model.
Figure 4:
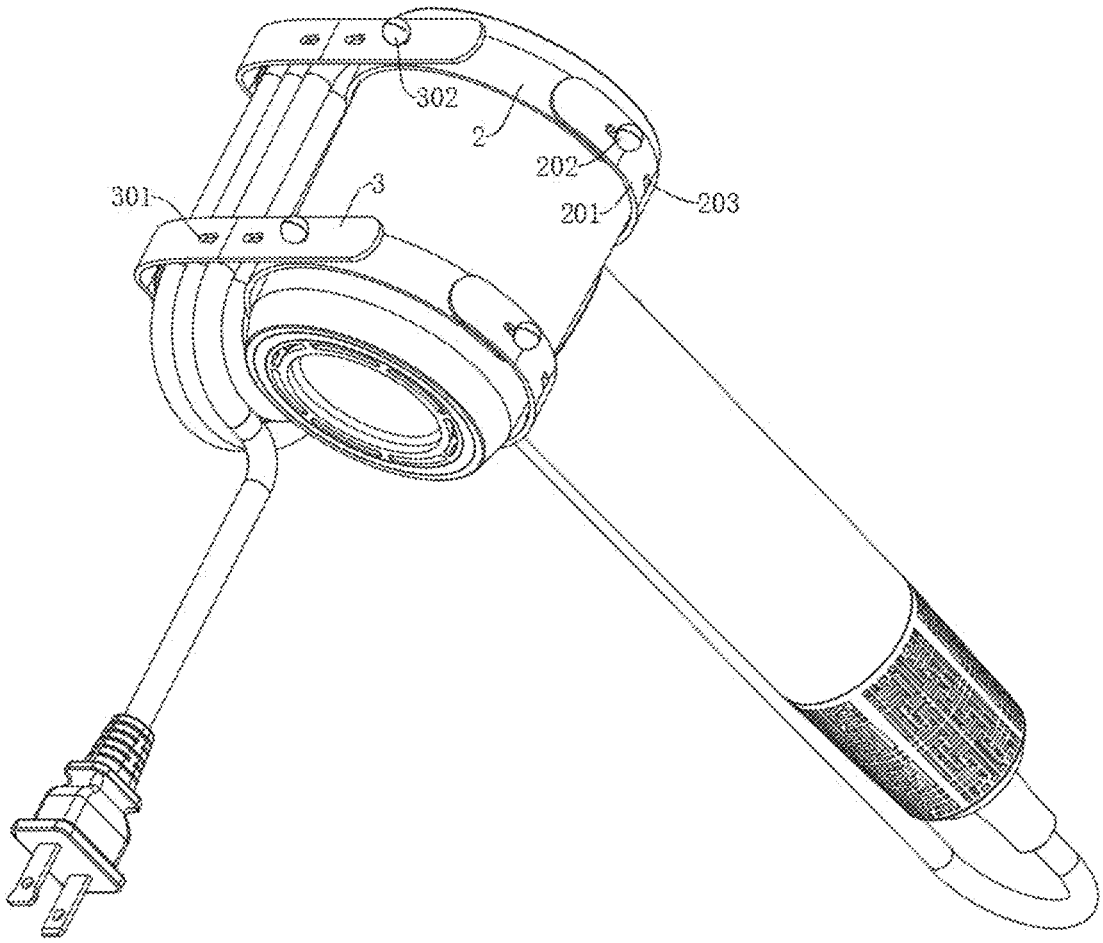
FIG. 4 is a schematic diagram of the power cord storage structure for the hair dryer provided in the utility model.

The following will provide a clear and comprehensive description of the technical solution in the embodiment of the present utility model, based on the accompanying drawings. It is evident that the described embodiment is only a part of the utility model embodiments, not exhaustive.

In describing the utility model, it is important to understand that terms such as "up", "down", "front", "back", "left", "right", "top", "bottom", "inner", "outer", etc., indicate directions or positional relationships based on the orientation or positional relationship shown in the drawings. These terms are used for descriptive convenience and simplification, rather than indicating or implying that the device or component must have specific orientation, be constructed and operated in a specific orientation. Therefore, they should not be construed as limitations on the utility model.

Embodiment 1

Referring to FIGS. 1-6, the power cord storage structure of the hair dryer comprises a winding part for winding the power cord of the hair dryer. It can be installed on the hair dryer, and during use, the winding part can be mounted on the hair dryer housing. The power cord can then be wound around the winding part, or directly onto the winding part. The winding part is suspended on the hair dryer housing via the power cord and is fixedly equipped with a retaining member to maintain the initial winding state of the power cord. The winding part is a structure protruding from the hair dryer housing and includes a board plate 1. The winding board 1 can be cylindrical, plate-shaped, or irregular in structure, with a preference for a plate-shaped structure. The winding board 1 has smooth rounded corners on both sides to reduce abrasion on the power cord. During use, the power cord can be wound around the winding board 1 to improve the storage effect. The retaining member on the winding part prevents the power cord from slipping off the winding board 1, thus maintaining the storage effect. The retaining member includes a baffle 101 fixedly installed on the winding board 1, forming a winding area between the baffle 101 and the hair dryer housing, where the power cord can be wound. The baffle 101 prevents the power cord from slipping off the winding board 1, and the winding board 1 is integrally formed with the hair dryer housing, preferably by injection molding, to enhance the connection strength between the winding board 1 and the hair dryer housing.

During use, the winding board 1 installed on the hair dryer allows for quick and effective cord storage, providing a neat, aesthetically pleasing, and space-saving solution. The baffle 101 fixedly installed on the winding board 1 prevents the power cord from slipping off, thus enhancing the storage effect. By fixing the third fixing strap 3 on the baffle 101, the power cord wound around the winding board 1 can be bundled, preventing it from loosening or falling off, thus ensuring effective storage.

Referring to FIG. 1, the winding board 1 can be detachably mounted on the hair dryer housing using screws, clasps, or similar means. Here, we have the first fixing strap 2 and the second fixing strap 201. The winding board 1 is fixed to the hair dryer housing using the first fixing strap 2 and the second fixing strap 201. Both ends of the first fixing strap 2 and the second fixing strap 201 are connected to the winding board 1, and their free ends are connected via a connector. During use, by fixing the first fixing strap 2 and the second fixing strap 201 on the winding board 1 and connecting their free ends via the connector, the winding board 1 can be secured to the hair dryer housing. This is suitable for hair dryers in the prior art that lack convenient cord storage, providing them with cord storage functionality.

Referring to FIG. 1, the connector can be a matching Velcro fastener fixed on the free ends of the first fixing strap 2 and the second fixing strap 201 for easy attachment to the hair dryer housing. Here, we design the connector as follows: a first limiting column 202 is fixedly installed on the free end of the first fixing strap 2. Multiple sets of first connecting grooves 203 are evenly spaced on the second fixing strap 201.

The first connecting grooves 203 can range from two to ten sets, with a preference for four sets. The first limiting column 202 is engaged with the corresponding first connecting groove 203. During use, the first fixing strap 2 and the second fixing strap 201 are wrapped around the hair dryer housing, and then tightened to engage the first limiting column 202 with the corresponding first connecting groove 203, thus securely fixing the winding board 1 to the hair dryer housing. This design is suitable for hair dryers of different diameters, enhancing versatility. Additionally, both the first fixing strap 2 and the second fixing strap 201 are symmetrically equipped with two sets.

Referring to FIGS. 1 to 6, the power cord storage structure of the hair dryer also includes a third fixing strap 3, which is evenly equipped with multiple sets of second connecting grooves 301. The second connecting grooves 301 can range from two to eight sets, with a preference for three sets. One end of the third fixing strap 3 is fixedly connected to the baffle 101, while the other end is free. When the free end is restrained, the third fixing strap 3 closes the winding area. During use, by setting the third fixing strap 3, after the power cord is wound, it can be bundled by the third fixing strap 3 to prevent it from loosening or falling off the winding board 1, thus improving the storage effect.

Referring to FIGS. 1 to 4, we fix a second limiting column 302 on the first fixing strap 2, and engage the second limiting column 302 with the second connecting groove 301. During use, by opening the second connecting grooves 301 on the third fixing strap 3 and fixing the second limiting column 302 on the first fixing strap 2, it facilitates the third fixing strap 3 to bundle the power cord, thus enhancing the storage effect.

Embodiment 2

Figure 5:
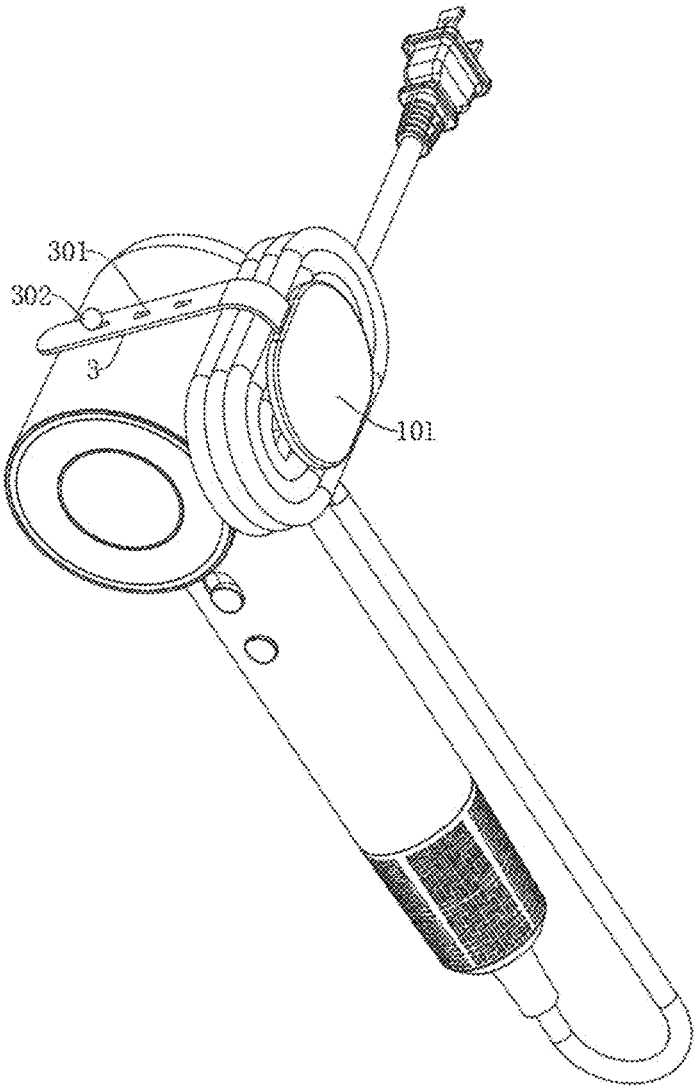
FIG. 5 is a schematic diagram of the power cord storage structure for the hair dryer provided in the utility model.
Figure 6:
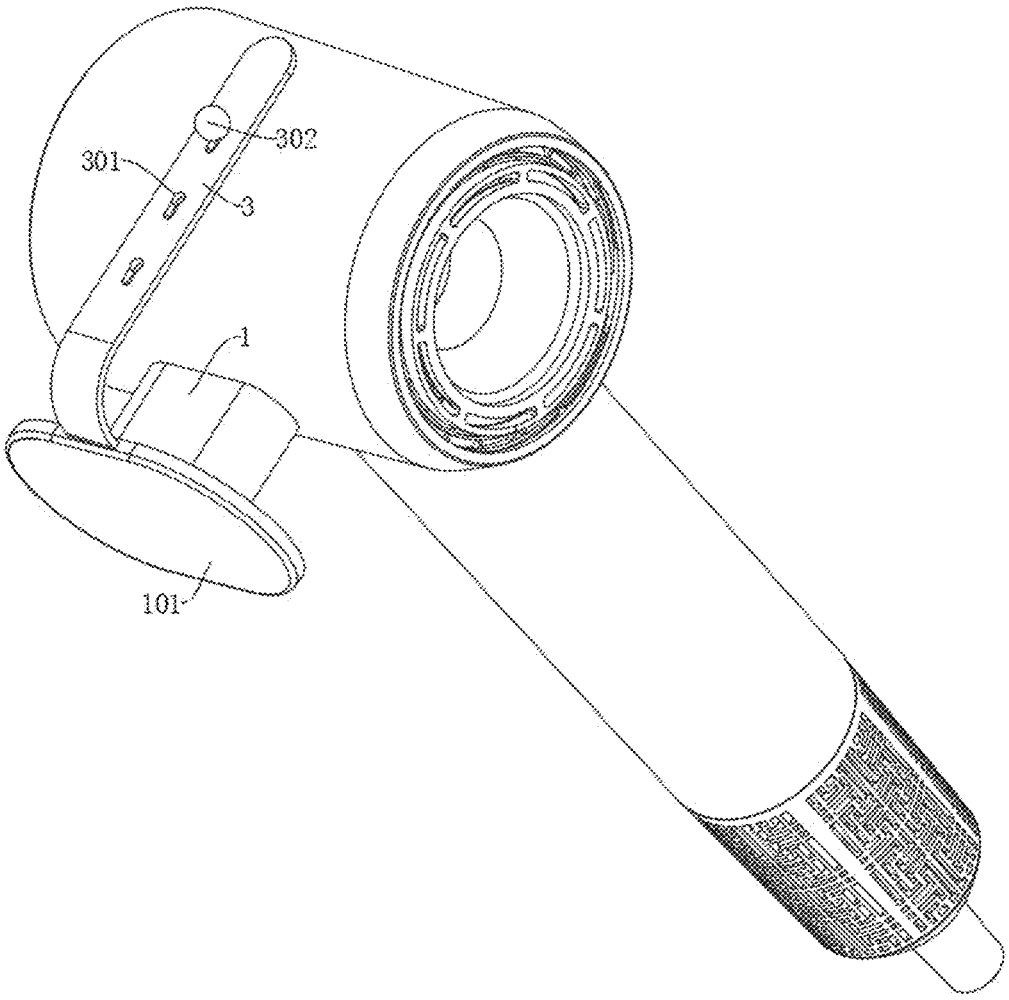
FIG. 6 is a schematic diagram of the power cord storage structure for the hair dryer provided in the utility model; and, in the figures: 1. winding board; 101. baffle; 2. first fixing strap; 201. second fixing strap; 202. first limiting column; 203. first connecting groove; 3. third fixing strap; 301. second connecting groove; 302. second limiting column.

Referring to FIGS. 5 and 6, which are essentially similar to the embodiment 1, based on the embodiment 1, when the winding board 1 is integrally formed with the hair dryer housing or connected to the hair dryer housing using screws or clasps without the first fixing strap 2 and the second fixing strap 201, the second limiting column 302 is fixed to the hair dryer housing. The second limiting column 302 is then engaged with the second connecting groove 301. During use, after winding the power cord around the winding board 1, the third fixing strap 3 is tightened, and then the second connecting groove 301 on the third fixing strap 3 is engaged with the second limiting column 302, thereby securing the power cord to the winding board 1 and enhancing the storage effect.

The above-described is only preferred embodiments of the utility model, but the scope of protection of the utility model is not limited thereto. Any person skilled in the art, within the technical scope disclosed by the utility model, may make equivalent replacements or modifications based on the technical solution and innovative concepts of the utility model, all of which should be encompassed within the scope of protection of the utility model.

What is claimed is:

1. A power cord storage structure of a hair dryer, the structure comprising a winding part for winding a hair dryer power cord, which can be installed on the hair dryer;

wherein a retaining member is fixedly provided on the winding part;

wherein the winding part comprises a winding board, wherein the winding board is a plate-shaped or columnar structure;

the power cord storage structure further comprising a first fixing strap (2) and a second fixing strap (201) fixedly provided on the winding part; and, wherein one end of the first fixing strap (2) and the second fixing strap (201) are both fixedly connected to the winding board (1), and a free end of the first fixing strap (2) and a free end the second fixing strap (201) are bundled on a hair dryer housing through connecting members.

2. The power cord storage structure of the hair dryer according to claim 1, wherein the connecting member comprises a first limiting column (202) fixedly set on the free end of the first fixing strap (2), wherein multiple sets of first connecting grooves (203) are equidistantly arranged on the second fixing strap (201), and the first limiting column (202) is engaged with a first connecting groove (203).

3. The power cord storage structure of the hair dryer according to claim 2, wherein the retaining member comprises a baffle (101) fixedly set on the winding board (1), wherein a winding area forms between the baffle (101) and the hair dryer housing.

4. The power cord storage structure of the hair dryer according to claim 3, further comprising a third fixing strap (3) equidistantly provided with multiple sets of second connecting grooves (301), wherein one end of the third fixing strap (3) is fixedly connected to the baffle (101), and another end of the third fixing strap (3) is a free end and wherein the free end is restricted, the third fixing strap (3) causes the winding area to be closed.

5. The power cord storage structure of the hair dryer according to claim 4, wherein a second limiting column (302) is fixedly provided on the first fixing strap (2), and the second limiting column (302) is engaged with the second connecting groove (301).

6. The power cord storage structure of the hair dryer according to claim 4, characterized in that the second limiting column (302) is fixedly provided on the hair dryer housing, and the second limiting column (302) is engaged with the second connecting groove (301).

* * * * *